US005259631A

United States Patent [19]

Brande

[11] Patent Number: 5,259,631

[45] Date of Patent: Nov. 9, 1993

[54] EMBROIDERY FLOSS AND ACCESSORIES BOX

[76] Inventor: Bruce Brande, 3214 Lettie St., Ames, Iowa 50010

[21] Appl. No.: 869,223

[22] Filed: Apr. 14, 1992

[51] Int. Cl.[5] ..... B65D 5/48

[52] U.S. Cl. ..... 229/121; 229/120.03; 229/120.19; 229/120.21; 229/122

[58] Field of Search ..... 229/121, 122, 120.03, 229/120.13, 120.18, 120.19, 120.21, 120.32, 120.36

[56] References Cited

U.S. PATENT DOCUMENTS

| | | | |
|---|---|---|---|
| 799,375 | 9/1905 | Gray | 229/120.32 |
| 1,174,872 | 3/1916 | Jolack | 229/122 |
| 1,407,073 | 2/1922 | Lyons | 229/122 |
| 2,105,163 | 1/1938 | Scandore | 229/120.32 |
| 2,137,705 | 11/1938 | Tiefry | 229/122 |
| 2,305,087 | 12/1942 | Keller | 229/120.13 |
| 2,584,048 | 1/1952 | Ramsey | 229/120.32 |
| 2,948,455 | 8/1960 | Frankenstein | 229/120.21 |
| 3,516,596 | 6/1970 | Madden et al. | 229/120.32 |
| 4,138,052 | 2/1979 | Torigan | 229/120.32 |
| 4,416,377 | 11/1983 | Swanberg | 229/122 |
| 4,437,713 | 3/1984 | Roach | 229/122 |
| 4,739,921 | 4/1988 | Taub | 229/120.32 |
| 4,934,589 | 6/1990 | Stephenson et al. | 229/122 |

FOREIGN PATENT DOCUMENTS

| | | | |
|---|---|---|---|
| 227644 | 1/1925 | United Kingdom | 229/120.03 |

OTHER PUBLICATIONS

"Floss Organizer" Advertisement: Westex Industries, Garfield, N.J. 07026.

*Primary Examiner*—Gary E. Elkins
*Attorney, Agent, or Firm*—Zarley, McKee, Thomte, Voorhees & Sease

[57] ABSTRACT

A box for storing embroidery floss and supplies includes a plurality of cells for receiving flat spools of skeins of floss, and an enlarged compartment for receiving embroidery accessories. The box includes a bottom wall, front and back walls, opposite side walls and a lid, all of which are constructed from a single blank of material. In one embodiment, the front wall opens for access to the cells and the lid opens for access to the enlarged storage compartment. In a second embodiment, the lid opens to provide access to both the spool cells and the enlarged storage compartment.

13 Claims, 6 Drawing Sheets

EMBROIDERY FLOSS AND ACCESSORIES BOX

BACKGROUND OF THE INVENTION

People who embroider normally have many skeins of differently colored floss or thread, as well as other supplies and accessories, such as scissors, needles, pins, thimbles, patterns and the like. It is convenient to be able to organize all of these embroidery materials in a single container. However, conventional storage boxes typically do not allow for organized storage of both the floss and other accessories.

The embroidery floss is normally purchased in the form of a skein, with a band secured around the skein. The band has indicia thereon to identify the color of the floss. In conventional floss organizer boxes, the identifying band is not used or is not visible. Also, some boxes require the person to rewrap the skein of floss around a spool, which is time consuming.

Accordingly, a primary objective of the present invention is the provision of an improved box for organizing embroidery floss and accessories.

Another objective of the present invention is the provision of an embroidery supply box which permits quick and easy organization of skeins of floss and other embroidery accessories.

A further objective of the present objective of the present invention is the provision of a unique spool for embroidery floss.

Yet another objective of the present invention is the provision of a spool upon which a skein of embroidery floss can be placed without unwrapping or rewinding, and which utilizes the color-identifying band of the floss.

Still another objective of the present invention is the provision of a box having a plurality of compartments for receiving skeins of embroidery floss, and a separate compartment for receiving embroidery accessories.

Another objective of the present invention is the provision of an embroidery organizer box which is economical to manufacture and durable in use.

These and other objectives become apparent from the following description of the invention.

SUMMARY OF THE INVENTION

A storage box is provided for organizing skeins of embroidery floss and embroidery accessories or supplies. The box includes a bottom, four walls, and a lid, all of which are formed from a single piece of folded material. The lid is pivotally connected to one of the walls. The walls define a compartment into which is placed a plurality of interlocking vertical and horizontal panels, which define a plurality of cells for receiving the skeins of floss. A tray or shelf is positioned in the compartment above the cells so as to define an enlarged storage area for the embroidery accessories. In one embodiment, one of the walls is pivotally connected to the bottom so as to be movable between an open position providing access to the cells and a closed position covering the cells. The lid is movable between an open position providing access to the accessory storage area and a closed position covering the storage area. In a second embodiment, the lid covers both the enlarged storage area and the cells when in the closed position.

A novel spool is provided for fitting into the floss cells. The spool comprises a flat, elongated member having a notch at each end. The member is flexible or resilient so that it can be arched to decrease the distance between the notches. In the arched position, the skein of floss can be placed on the spool, after the identifying band has been removed therefrom and without unwrapping the skein. In its normal position, the distance between the notches of the flat spool member is sufficient so as to maintain the floss on the spool, with the ends of the spool member extending slightly beyond the floss. The identifying band can be slipped over a tab on one end of the spool member so that identification of the floss color can be easily made when the spool is inserted in a cell of the box. A slot on one end of the spool securely holds the end of the floss so that the floss does not unwind from the spool.

DETAILED DESCRIPTION OF THE DRAWINGS

Figure 1:
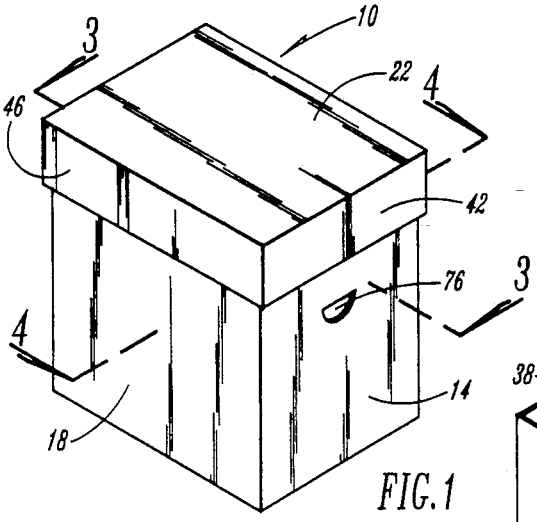
FIG. 1 is a perspective view of one embodiment of the embroidery floss and accessories box of the present invention.

The first embodiment of the embroidery floss and accessory organizing box of the present invention is shown in FIGS. 1–7. The box is generally designated by the reference numeral 10. Box 10 includes a bottom, a front wall 14, a back wall 16, opposite side walls 18, 20, and a lid 22.

Figure 2:
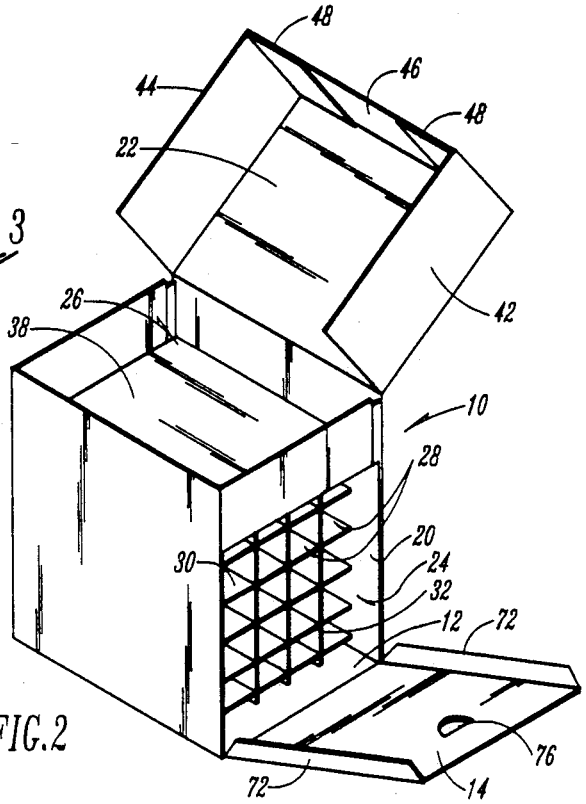
FIG. 2 is a view similar to FIG. 1 showing the box with the lid open and the front wall open.
Figure 4:
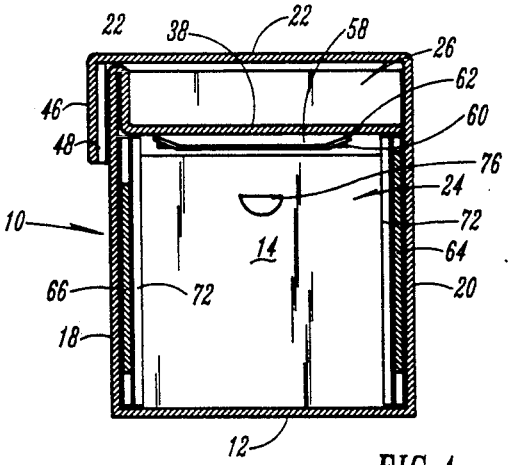
FIG. 4 is a view taken along lines 4—4 of FIG. 1.
Figure 5:
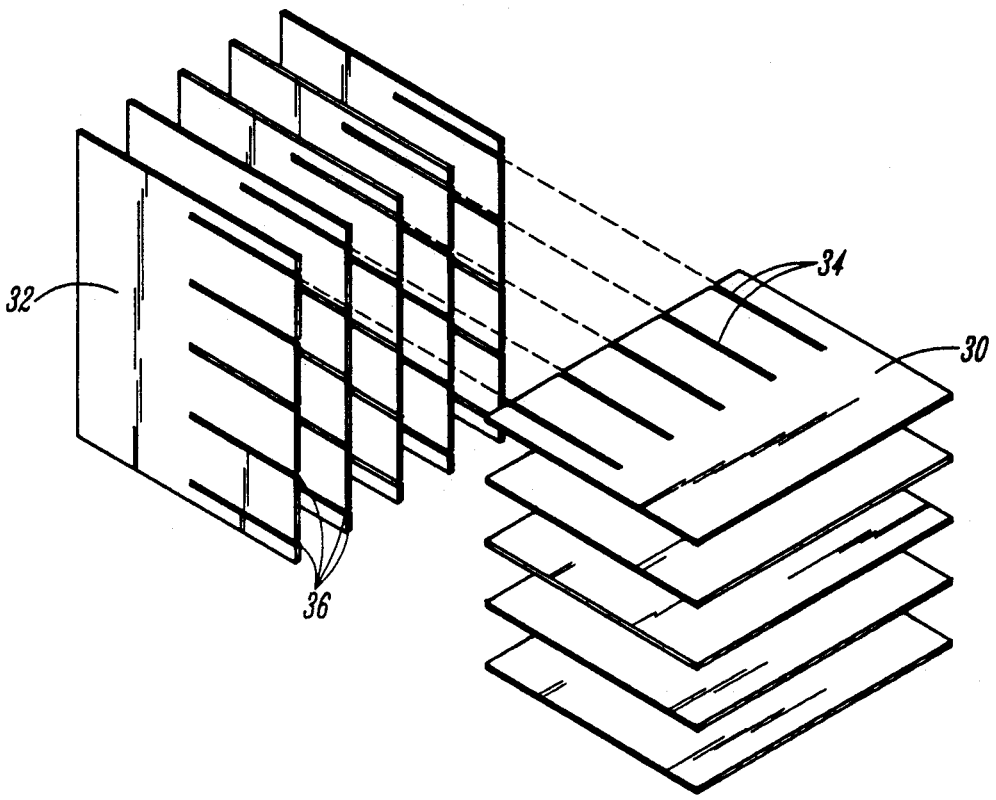
FIG. 5 is an exploded perspective view of the cell panels of the box.
Figure 6:
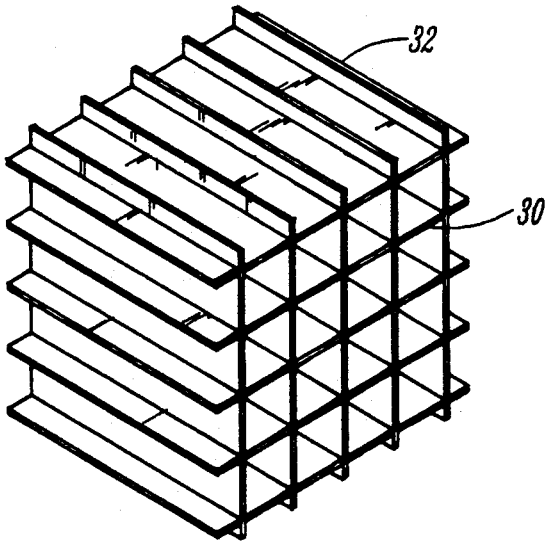
FIG. 6 is an perspective view of the assembled cell panels.

As best seen in FIGS. 2 and 4, the box has a lower compartment 24 and an upper compartment 26. Lower compartment 24 is subdivided into a plurality of cells 28 by horizontal panels 30 which are interlocked with vertical panels 32, as seen in FIGS. 5 and 6. More particularly, panels 30 and 32 have corresponding slots 34, 36, respectively, which are aligned such that the panels can be interlocked to form the grid pattern of cells 28, as best seen in FIG. 6.

Compartment 26 is formed by a tray or shelf 38, which is supported by the tops of vertical panels 32. Tray 38 is integrally connected to side wall 18, as seen in FIGS. 4 and 7.

Except for panels 30 and 32, box 10 is formed from a single piece of material, preferably cardboard. FIG. 7 shows the blank, wherein solid lines represent cuts in the material, single dotted lines represent creases or scores wherein 90° folds are made, and double dotted lines represent creases or scoring wherein 180° folds are made.

Figure 7:
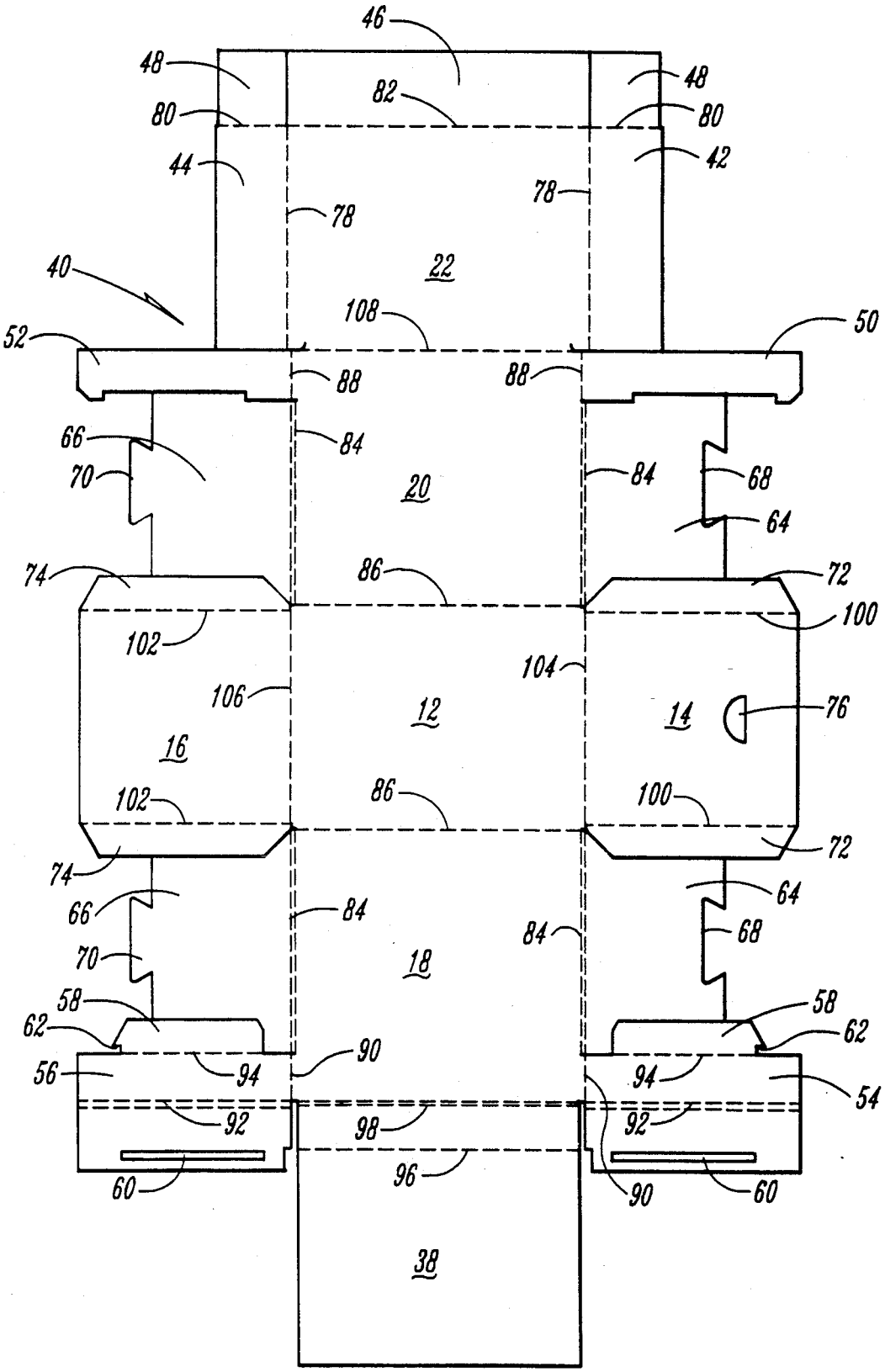
FIG. 7 is a plan view of the box blank in an unfolded condition.

More particularly, as seen in FIG. 7, blank 40 includes bottom 12, front wall 14, back wall 16, opposite side walls 18 and 20, and lid 22. Lid 22 includes a front flap 42, a back flap 44, and a side flap 46. Front and back flaps 42, 44 have end sections 48.

Blank 40 also includes an upper front insert 50 and an upper back insert 52, which are adapted to be received within an upper front collar 54 and an upper back collar 56. A lock tab 58 is adapted to extend through a slot 60 on each of the front and back collars 54, 56. Lock tab 58 has a shoulder 62 to lock the tab in position in slot 60.

Figure 3:
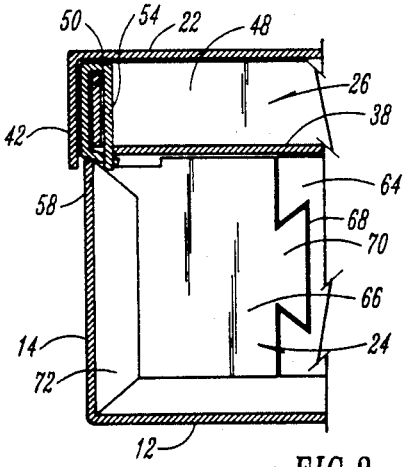
FIG. 3 is a sectional view taken along lines 3—3 of FIG. 1.

Blank 40 also includes a female inner side wall flap 64 and a male inner side wall flap 66 extending from each of the opposite sides 18, 20. Flap 64 includes a female recess 68, while flap 66 includes a male tab 70. As seen in FIG. 3, the male tab is adapted to be matingly received within the female recess 68.

Front wall 14 includes opposite tabs 72 and back wall 16 includes opposite tabs 74. Front wall 14 is also provided with a hole 76 into which a finger can be inserted for opening front wall 14.

The assembly of blank 40 into box 10 is accomplished through the following steps. First, flaps 42 and 44 of lid 22 are folded along lines 78 and end sections 48 are folded along lines 80. Flap 46 is then folded along line 82 and glued or otherwise secured to end sections 48, such that the lid 22 will remain in the configuration shown in FIG. 2.

Next, inner side wall flaps 64 and 66 are folded 180° along dual fold lines 84 such that male tabs 70 are received within female recesses 68.

Opposite sides 18 and 20 are folded upwardly along fold lines 86. Inserts 50, 52 are folded 90° along lines 88, and collars 54, 56 are folded 90° along lines 90. Collars 54, 56 are then folded 180° along dual fold lines 92 and tabs 58 are folded along lines 94 for receipt in slots 60.

The grid work of cells 28 are then dropped into the lower compartment 24. Tray 38 is then folded 90° along line 96 and again 180° along dual fold lines 98, such that tray 38 will be supported by the tops of vertical panels 32.

Flaps 72 on front 14 are folded 90° inwardly along lines 100, and tabs 74 of back wall 16 are likewise folded inwardly along lines 102. Front wall 14 and back wall 16 can then be folded upwardly 90° along lines 104 and 106, respectively, such that tabs 72, 74 are received within lower compartment 24 along the inner sidewall flaps 64, 66. Tabs 74 can be glued or otherwise secured to sidewall flaps 66 so that the back wall 16 is fixed. Front wall 14 remains free to open and close with pivotal movement about fold line 104. Access to cells 28 is provided by pivoting front wall 14 downwardly to the open position, as shown in FIG. 2, and cells 28 are covered by pivoting front wall 14 upwardly to the closed position, as seen in FIG. 1.

Finally, lid 22 is pivotal about fold line 108 so that the lid can be moved between an open position, shown in FIG. 2, providing access to upper compartment 26 and a closed position, shown in FIG. 1, closing the upper compartment.

Figure 8:
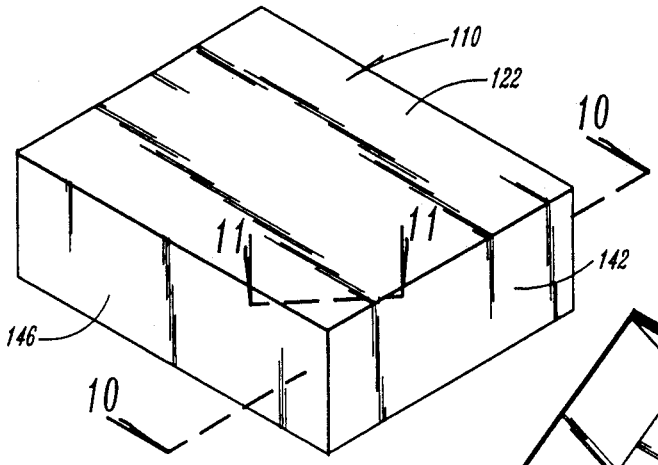
FIG. 8 is a perspective view of an alternative embodiment of the box of the present invention.
Figure 9:
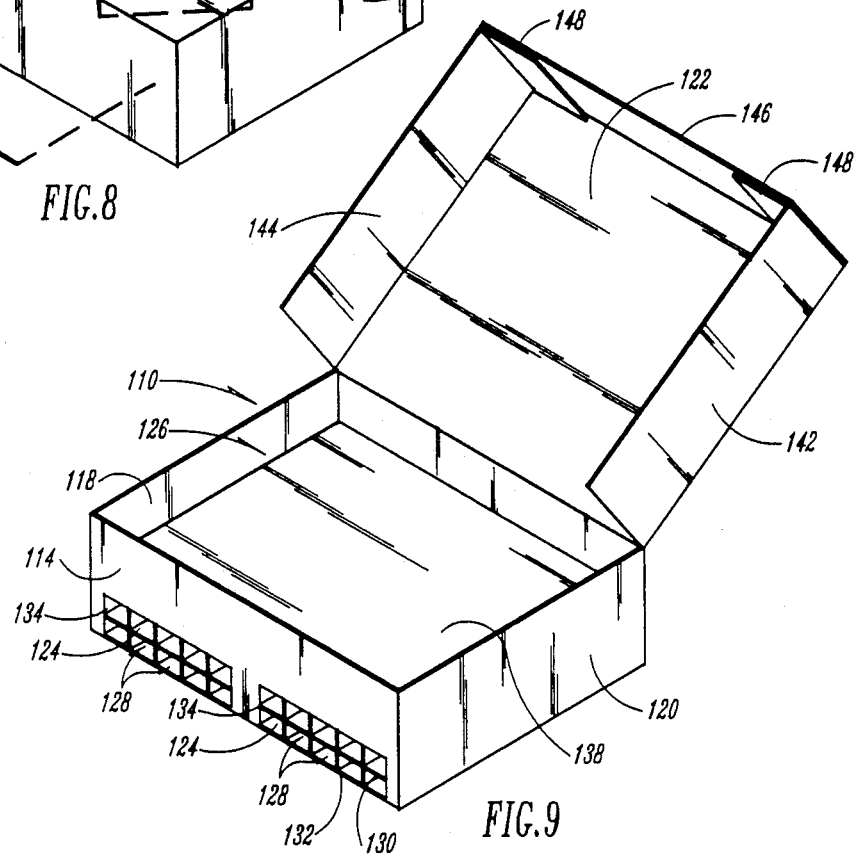
FIG. 9 is a perspective view of the box shown in FIG. 8 with the lid open.
Figure 10:
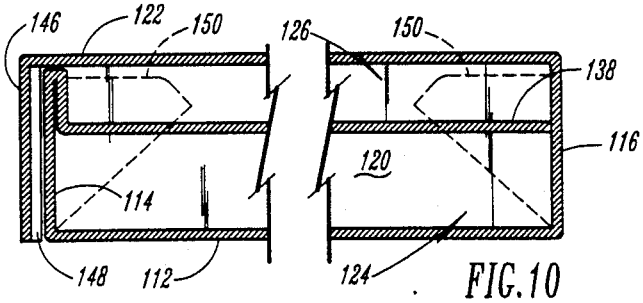
FIG. 10 is a sectional view taken along lines 10—10 of FIG. 8.

FIGS. 8–12 show a second embodiment of the embroidery floss and accessory organizer box of the present invention. The second embodiment is generally designated by the numeral 110. Box 110 includes a bottom 112, a front wall 114, a back wall 116, opposite side walls 118, 120, and a lid 122. Box 110 includes a lower compartment 124 and an upper compartment 126, as best seen in FIG. 10. Lower compartment 124 includes a plurality of cells 128 formed by interconnected horizontal panels 130 and vertical panels 132. Panels 130 and 132 are similar in construction to panel 30 and 32 described above with respect to the first embodiment of box 10.

Front wall 114 includes a pair of openings 134 which provide access to cells 128. Box 110 includes a tray 138, which is integrally formed with front wall 114 and is supported by the upper ends of vertical panels 132. Tray 138 defines the bottom of the upper compartment 126.

Figure 12:
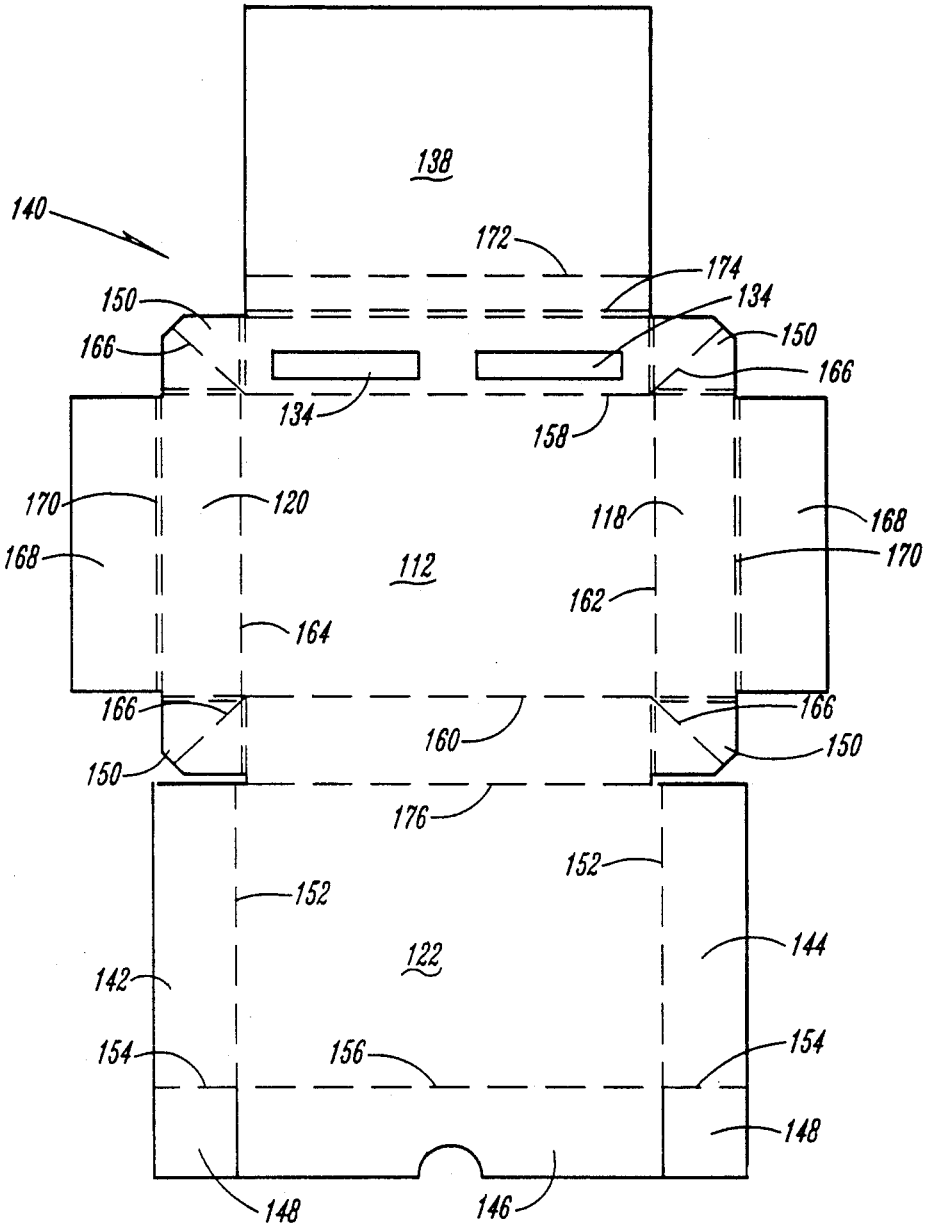
FIG. 12 is a plan view of the box blank shown in FIG. 8 in an unfolded condition.
Figure 13:
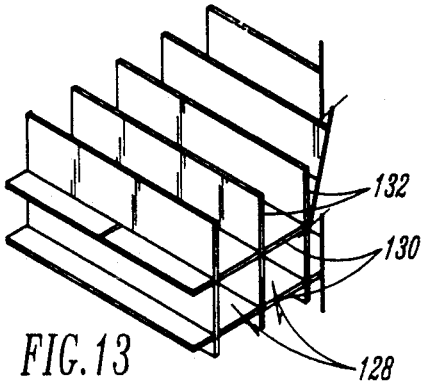
FIG. 13 is a perspective view of the floss cells used in the box in FIG. 8.

With the exception of horizontal and vertical panels 130, 132, box 110 is formed from a single blank 140 of material, as seen in FIG. 12. Lid 122 has opposite side flaps 142, 144 and a front flap 146. Each side flap 142, 144 has an end section 148. Four corner inserts 150 are integrally formed and interconnect the ends of front and back walls 114, 116 to the opposite side walls 118, 120.

In folding blank 140 to construct box 110, the following steps are taken. First, side flaps 142, 144 of lid 122 are folded 90° along fold lines 152. End sections 148 are folded along fold lines 154. Then, front flap 146 is folded along fold line 156, and end sections 148 are secured to the inside of flap 146 with glue or the like, so as to maintain lid 22 in the form shown in FIG. 9.

Figure 11:
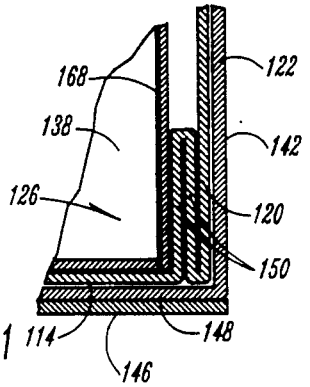
FIG. 11 is a partial sectional view taken along lines 11—11 of FIG. 8.

Front wall 114, back wall 116, and opposite side walls 118–120 are folded 90° along respective lines 158, 160, 162 and 164, while corner inserts 150 are folded inwardly along lines 166. Extension or inner flap 168 is then folded 180° over the folded corner sections 150, along dual fold lines 170 so as to sandwich the folded corner insert 150 between the side wall 118 or 120 and the associated inner flap 168, as best seen in FIG. 11.

The grid work of panels 130, 132 is then inserted into lower compartment 124 of box 110. Tray 138 is then folded along line 172 and dual line 174 so as to rest upon top edges of vertical panels 132.

Lid 122 is pivotal along fold line 176 so as to be movable between an open position, shown in FIG. 9, providing access to both the upper compartment 126 and the cells 128 in lower compartment 124, and a closed position covering upper compartment 126 and openings 134 to cells 128, as seen in FIG. 8.

The present invention also includes a uniquely shaped spool 180 for use in the cells 28 and 128 of boxes 10 and 110, respectively. As seen in FIGS. --17, spool 180 is a flexible elongated member having a notch 182 at each of the opposite ends. A skein of floss 184 is adapted to be placed on the spool member for retention in the notches 182.

Figure 14:
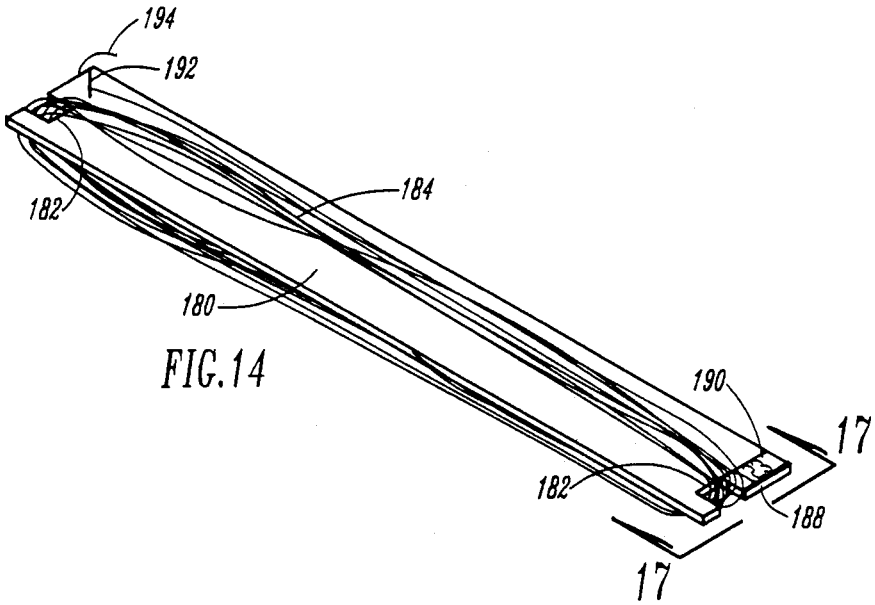
FIG. 14 is a perspective view of the floss spool of the present invention.
Figure 15:
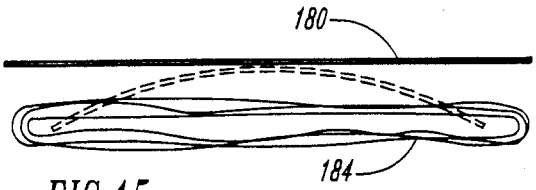
FIG. 15 is a side elevational view showing the spool in its normal flat condition and showing the spool in broken lines in a flexed position.
Figure 17:
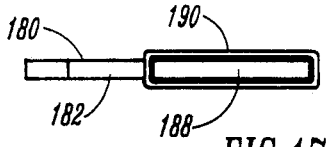
FIG. 17 is an end view taken along lines 17—17 of FIG. 14.
Figure 16:
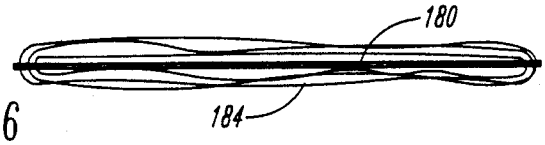
FIG. 16 is a view similar to FIG. 15 showing the spool in its normal condition with the skein of floss mounted thereon.

More particularly, floss is normally purchased at retail in a manufactured loop or skein with a color indicating band placed around the skein. To place the skein of floss 184 on spool 180, the band is removed from the skein. Spool 180 is then arched or flexed, as shown in dotted lines in FIG. 14, such that the distance between notches 182 is less than the length of the floss skein 184, and such that the ends of the skein can be received in notches 182. Spool 180 is then released such that it returns to its normal flat condition, as shown in solid lines in FIG. 14, wherein the space between notches 182 is substantially equal to the length of the floss skein 184, such that the skein is maintained on spool 180. Due to resiliency of spool 180, the floss does not have to be wound around the spool, but rather can be placed on the spool as a manufactured skein.

One end of spool 180 includes a tab 188 which has a width substantially equal to the width of the floss color-indicia band 190. Thus, band 190 can be slipped over tab 188 so that the user can easily identify the floss when spool is stored in one of the cells 28 or 128. The opposite end of spool 180 includes a slot 192 for securing the end 194 of the floss, such that the skein does not come unraveled from spool 180.

In use, different colored skeins of floss can be placed on spools 180, and the spools stored within cells 28, 128. Various embroidery supplies, such as scissors, thimbles, pins, needles and patterns can be stored on tray 38 or 138 in the upper compartment 26 or 126. Upper compartment 126 is large enough to store conventionally-sized magazines without folding or rolling the magazine. Thus, the floss and supplies used for embroidering can be conveniently stored in one box.

From the foregoing, it can be seen that the present invention accomplishes at least all of the stated objectives.

What is claimed is:

1. An embroidery floss and accessories box comprising:

a bottom;

four side walls extending upwardly from the bottom so as to define a compartment therebetween;

dividing walls positioned within the compartment to subdivide the compartment into a plurality of cells for storing skeins of embroidery floss;

a tray positioned in the compartment above the cells for storing embroidery accessories;

a lid movable between an open position providing access to the tray and a closed position covering the tray;

the bottom, the side walls, the tray and the lid being integrally connected and formed from a single piece of material; and the tray and cells being simultaneously accessible.

2. The box of claim 1 wherein one of the side walls is movable between an open position providing access to the cells and a closed position covering the cells.

3. The box of claim 1 wherein one of the side walls has at least one opening therein to provide access to the cells.

4. The box of claim 3 wherein the lid includes a flap member for covering the opening and cells when the lid is in the closed position.

5. The box of claim 1 wherein the tray is supported by the dividing cells.

6. The box of claim 1 wherein the lid is pivotally connected to one of the side walls.

7. The box of claim 1 wherein the tray is an extension of one of the side walls.

8. The box of claim 1 wherein the cells are formed from a plurality of interlocking horizontally and vertically disposed panels.

9. A box for storing embroidery floss and supplies, comprising:

a single piece of material forming a bottom, opposite end walls, opposite side walls, and a lid;

a plurality of cells for receiving skeins of floss;

a compartment for receiving the supplies; and the compartment and cells being simultaneously accessible.

10. The box of claim 9 wherein the cells are formed from a plurality of interlocking horizontally and vertically disposed panels.

11. The box of claim 9 wherein the lid is movable between an open position providing access to the compartment and a closed position closing the compartment, and one end wall is movable between an open position providing access to the cells and a closed position closing the cells.

12. The box of claim 9 wherein the lid is movable between an open position providing access to the cells and to the compartment and a closed position closing the cells and the compartment.

13. The box of claim 9 wherein the compartment includes a tray supported by the cells.

* * * * *